US006637112B2

(12) United States Patent
Davis

(10) Patent No.: US 6,637,112 B2
(45) Date of Patent: Oct. 28, 2003

(54) BOX CUTTER WITH DEFLECTABLE SAFETY SHIELD

(75) Inventor: Raymond E. Davis, Garland, TX (US)

(73) Assignee: Dallco Marketing, Inc., Garland, TX (US)

( * ) Notice: Subject to any disclaimer, the term of this patent is extended or adjusted under 35 U.S.C. 154(b) by 62 days.

(21) Appl. No.: 10/011,222

(22) Filed: Oct. 25, 2001

(65) Prior Publication Data

US 2003/0079351 A1 May 1, 2003

(51) Int. Cl.[7] ..... B26B 29/02

(52) U.S. Cl. ..... 30/2; 30/162; 30/286; 30/295; 30/335

(58) Field of Search ..... 30/2, 151, 162, 30/286, 295, 293, 294, 335

(56) References Cited

U.S. PATENT DOCUMENTS

| | | | | |
|---|---|---|---|---|
| 3,781,988 A | | 1/1974 | Jones | 30/2 |
| 4,031,616 A | | 6/1977 | Hines et al. | 30/2 |
| 4,086,698 A | | 5/1978 | Sparks | 30/2 |
| 4,091,537 A | | 5/1978 | Stevenson, Jr. | 30/286 |
| 4,503,612 A | | 3/1985 | Davis | 30/2 |
| 4,531,286 A | | 7/1985 | Vito et al. | 30/2 |
| 4,675,996 A | | 6/1987 | DuBuque | 30/2 |
| 4,744,146 A | | 5/1988 | Schmidt | 30/162 |
| 4,980,977 A | | 1/1991 | Matin et al. | 30/286 |
| 4,987,682 A | | 1/1991 | Minnick | 30/2 |
| 5,054,198 A | | 10/1991 | Gmoch | 30/2 |
| 5,241,750 A | | 9/1993 | Chomiak | 30/2 |
| 5,285,574 A | | 2/1994 | Feltner | 30/2 |
| 5,386,632 A | | 2/1995 | Schmidt | 30/125 |
| 5,522,135 A | | 6/1996 | Votolato | 30/2 |
| 5,581,893 A | | 12/1996 | Ouellette | 30/2 |
| 5,613,300 A | | 3/1997 | Schmidt | 30/2 |
| 5,697,157 A | | 12/1997 | Votolato | 30/2 |
| 5,852,874 A | | 12/1998 | Walker | 30/2 |
| 5,890,290 A | | 4/1999 | Davis | 30/2 |
| 6,035,534 A | | 3/2000 | Abbott | 30/2 |
| 6,070,326 A | * | 6/2000 | Berns | 30/2 |
| 6,178,640 B1 | | 1/2001 | Votolato | 30/2 |

* cited by examiner

*Primary Examiner*—Hwei-Siu Payer
(74) *Attorney, Agent, or Firm*—Dennis T. Griggs

(57) ABSTRACT

A deflectable safety shield extends transversely across a cutting plane in a protective guard position completely overlying the cutting edge of a utility knife. A portion of the shield extends over-center with respect to the cutting edge, thereby tending to hold the shield in the guard position in response to contact of the shield against the operator at the normal angle of engagement during follow-through that accompanies rapid slicing hand movements. The shield is resiliently biased for movement to the guard position by a torsion spring. An outwardly-turned flange portion of the shield provides an angularly offset leverage point for reacting the torsion spring when the operator desires to perform a cutting operation. The shield swings away from the cutting plane automatically in response to pressure engagement of the offset flange portion against the box surface, thus exposing the cutting edge.

19 Claims, 3 Drawing Sheets

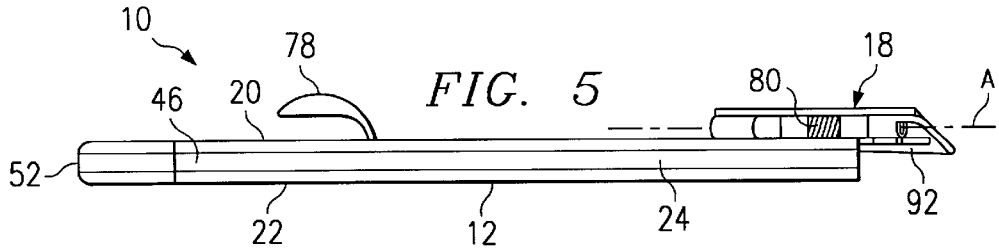
FIG. 5
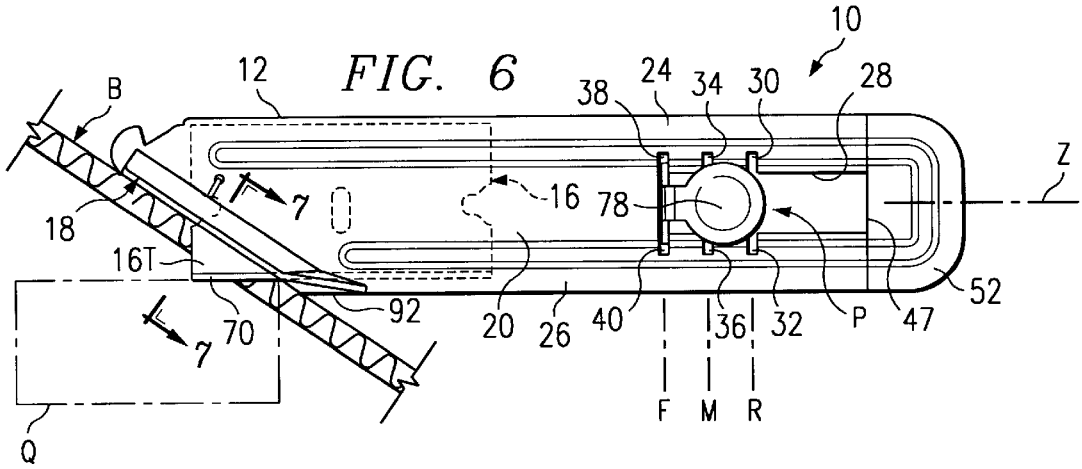
FIG. 6
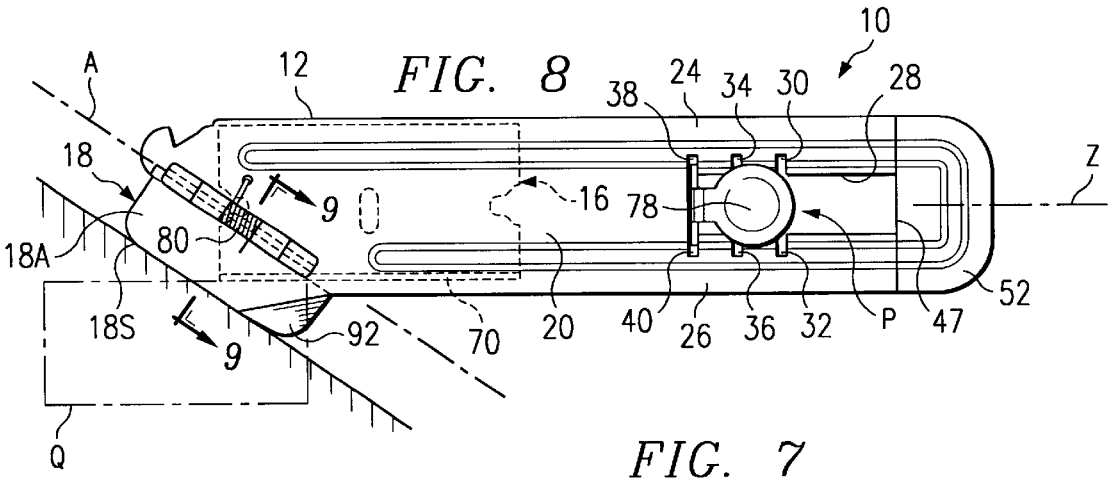
FIG. 8
FIG. 7
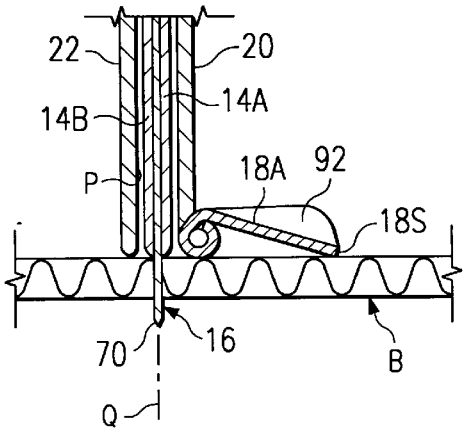

BOX CUTTER WITH DEFLECTABLE SAFETY SHIELD

BACKGROUND OF THE INVENTION

This invention relates generally to utility knives, and in particular to hand-held box cutters of the type used by stocking clerks to open cardboard cartons, for example in grocery stores, supermarkets, convenience stores, restaurants and other retail establishments.

Utility knives, commonly known as box cutters, include a housing or handle in which a blade is secured for cutting a variety of materials, for example paper stock, plastic sheeting, floor tiles, linoleum, carpeting, thin wood panels, wall paper, banding straps, tape and sealed plastic sacks containing bulk materials. Of special interest are sealed containers and boxes constructed of paperboard, usually corrugated cardboard, in which individually packaged items are shipped. Typically, cardboard containers are taped or glued shut. When a cardboard container is to be opened, a slicing movement is made by pulling the knife rapidly across the top or side of the container to obtain a clean, straight cut. Sharp blades are required for efficient opening of cartons, and a very sharp single-edged razor blade is commonly used for that purpose. This simple task has resulted in many on-the-job personal injuries.

A cardboard carton is generally held steady in front of the operator with one hand and is cut by pulling the knife with the other hand toward the operator across the top or sidewall of the carton. Because such use frequently involves quick hand movements, and the cardboard presents considerable resistance to cutting, flesh wounds are likely when the knife blade travels free at the end of a cut and catches the operator's hand, fingers, arm, waist or leg. Consequently, special attention must be given to protecting the operator who must work quickly and repetitively.

Both fixed-blade and adjustable blade box cutters are known in the art. In some knives, the blade is fixed and unprotected. Other utility knives have a retractable guard or an extendable and retractable blade. Those knives can inadvertently cut the operator during use if the utility knife contacts the operator at the normal angle of engagement during rapid slicing hand movement. During use, the utility knife with a retractable blade will be operated with the retractable blade extended and so will provide no more protection from inadvertent cuts than the unprotected blade.

U.S. Pat. No. 5,054,198 (Gmoch) discloses a carton opener including a fixed guide portion for guiding the blade at a fixed distance along the corner edge of a carton. The fixed guide portion acts as a safety shield and allows the operator to quickly and accurately guide the blade closely along the edge of a carton.

U.S. Pat. No. 5,522,135 (Votolato) discloses a box opener including a movable shield rotatably attached to the box opener handle for pivotal movement between an extended position in which the blade is protected and a retracted position in which the blade edge is exposed for cutting. The shield is biased to the protective position by a cantilever spring. The shield rotates away from the cutting edge of the blade when the shield contacts a surface at about a 90° angle.

U.S. Pat. No. 3,781,988 (Jones) discloses a blade holder with a guard pivotally attached to the holder for retracting movement to uncover the corner of a blade. A tension spring biases the guard to the protected position. Contact pressure causes the guard to yield and pivot away from the covered position as the cutting edge enters the work piece.

U.S. Pat. No. 6,035,534 (Abbott) discloses a carton knife with a fixed guide that maintains the blade at an oblique angle relative to the corner edge of the cutting surface during cutting. The guide prevents the operator from cutting too deeply and damaging the product inside the carton.

Despite the springlike guards on some carton cutters, such as the resilient deflectable spring guard shown in my U.S. Pat. No. 4,503,612, there remains a serious threat of cuts since the guard retracts and the cutting edge of the blade is automatically exposed in response to the shield contacting any surface, including the operator, at the normal angle of cutting engagement during rapid hand movement. This risk may never be totally eliminated since the blade is necessarily exposed while it is engaged with the carton. However, there remains considerable interest in improving the design and construction of box cutters so that they can be used effectively while minimizing the risk of personal injury caused by inadvertent contact with the operator immediately after a slicing maneuver has been completed. It is also important for the operator to be able to handle the box cutter with the same care and attention devoted to other hand tools and with confidence that an accidental cut is not likely, for example when picking up the knife and handling it in preparation for a job, putting the knife away or carrying it while it is not being used.

BRIEF SUMMARY OF THE INVENTION

The present invention provides a box cutter with a deflectable safety guard or shield that extends transversely across the cutting plane of the blade in a protective guard position that completely overlies and covers the cutting edge. The shield is coupled to the cutter housing by a hinge that supports swinging movement of the shield from the guard position in which the cutting edge is covered, to a retracted position in which the cutting edge is exposed. A portion of the shield extends over-center with respect to the cutting plane of the blade, so that pressure forces acting against the shield tend to hold the shield in the guard position. Thus the cutting edge of the blade remains covered in response to contact of the shield against the operator at the normal angle of engagement during follow-through that accompanies rapid hand movements. The shield is resiliently biased for return movement to the protective guard position by a torsion spring.

The shield includes a small outwardly-turned flange portion that projects transversely with respect to the shield. The flange portion prevents inadvertent digging into the cutting surface and provides an angularly offset leverage point on the lower end of the shield for reacting the torsion spring when the operator desires to perform a cutting operation. The shield swings away from the cutting plane automatically in response to pressure engagement of the small flange portion against the box surface, thus exposing the cutting edge. The torsion spring yieldably opposes swinging movement of the shield away from the guard position and returns the shield to the guard position automatically upon disengagement. The shield covers the cutting edge and prevents inadvertent blade contact with the operator immediately after the knife is disengaged and during follow-through that accompanies rapid hand movements.

BRIEF DESCRIPTION OF THE DRAWING

The accompanying drawing is incorporated into and forms apart of the specification to illustrate the preferred embodiments of the present invention. Various advantages and features of the invention will be understood from the following detailed description taken with reference to the attached drawing figures in which:

FIG. 5 is a top plan view thereof;

FIG. 6 is a left side elevation view thereof, showing the safety shield in the retracted, cutting position;

FIG. 7 is a sectional elevation view of the cutting blade and safety shield taken along the line 7—7 of FIG. 6, showing the safety shield in the retracted, cutting position;

FIG. 8 is a left side elevation view thereof, showing the safety shield in the retracted, cutting position;

DETAILED DESCRIPTION OF THE INVENTION

Figure 1:
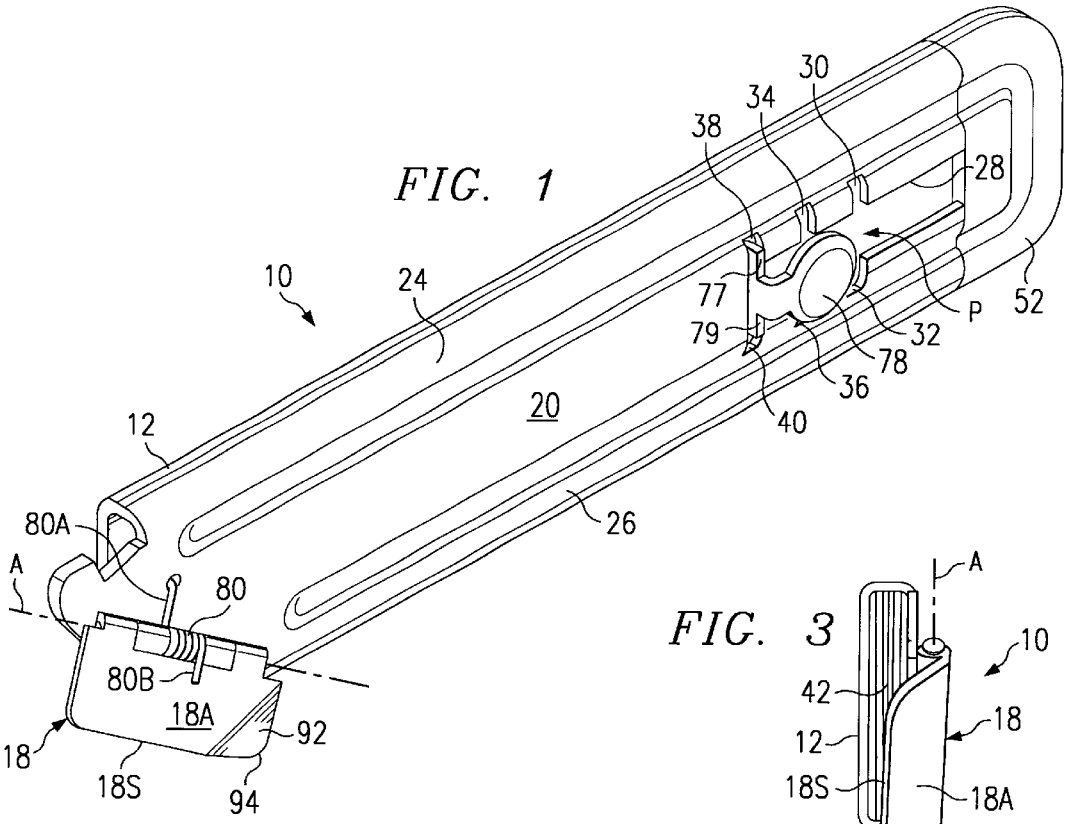
FIG. 1 is a front perspective view of a box cutter equipped with the safety shield of the present invention.
Figure 3:
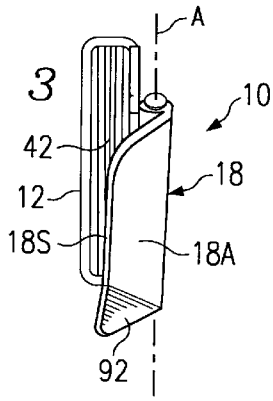
FIG. 3 is a front elevation view thereof.
Figure 2:
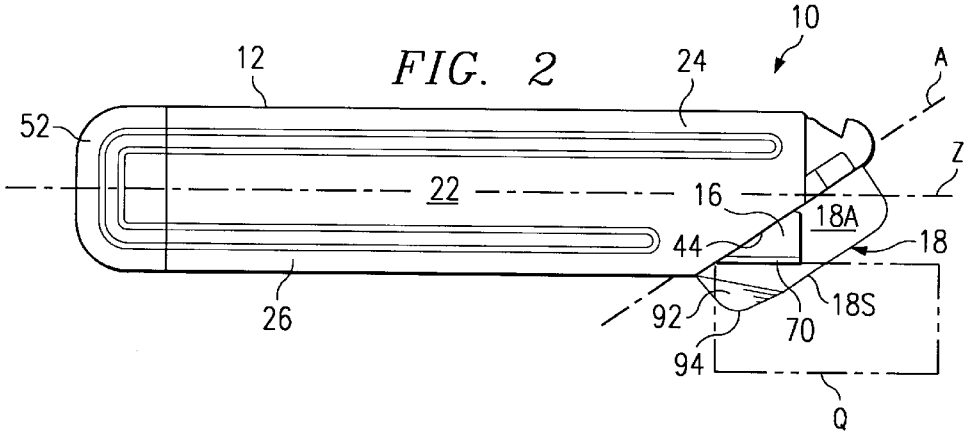
FIG. 2 is a right side elevation view thereof, showing the shield in the protective position.
Figure 4:
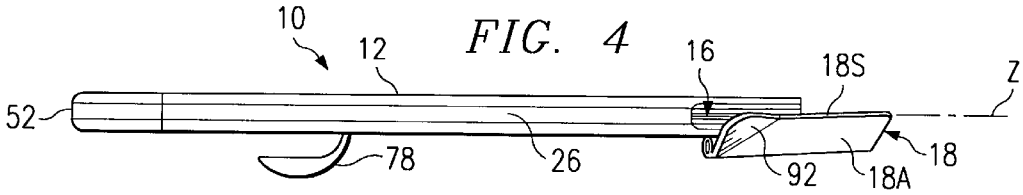
FIG. 4 is a bottom plan view thereof.

A preferred embodiment of the invention will now be described with reference to various examples of how the invention can best be made and used. Like reference numerals are used throughout the description and several views of the drawing to indicate like or corresponding parts. As used herein, "utility knife" and "box cutter" are used interchangeably to refer a hand-held knife of the type used open cardboard cartons The improved, adjustable-blade utility knife 10 of the present invention is illustrated in FIGS. 1–10. The utility knife 10 is designed for cutting corrugated paperboard and other sheet material and hence is ideally suited for slitting the walls of corrugated paperboard boxes and to open cardboard cartons, for example in grocery stores, supermarkets, convenience stores, restaurants and other retail establishments. The utility knife 10 can also be used to safely cut a variety of materials, for example plastic sheeting, floor tiles, linoleum, carpeting, thin wood panels, wall paper, banding straps, tape and plastic sacks containing bulk materials.

Unlike traditional box cutters equipped with exposed blades, the cutting edge of the utility knife 10 is covered by a shield the instant the blade is withdrawn from a cut, so it is less likely to inflict injury during use or when handled casually with the blade extended. The principal components of the utility knife 10 include a handle 12, a blade holder or keeper-plate 14 which fits into the handle 12, a blade 16 which is retained in the keeper-plate 14 and a spring-loaded guard or shield 18 attached to the handle which covers the cutting edge of the blade 16 when it is not engaged against a cardboard container or other workpiece.

The handle 12 is preferably cut from a blank of hardenable material, for example 1/16" (0.0625 in.) thick sheet aluminum, then stamped out as a single part and folded to form a hollow handle. The handle 12 is folded about an open-ended, longitudinally-extending slide pocket P separating a pair of oppositely facing handle webs 20, 22 between top and bottom edge portions 24 and 26. The webs provide smooth sidewall surfaces for slidably receiving and confining the keeper-plate 14 and the blade 16. The handle 12 is preferably stamped to include positioning features, including a latch receiver consisting of a rectangular latch slot 28 formed through the sidewall web 20 and aligned pairs of detent notches 30, 32; 34,36; and 38,40 that open into the latch slot. The detent notches are longitudinally spaced apart at positions F, M and R that correspond with predetermine depths of cut, and are engagable with a latch shoulder carried on the keeper plate 14 as described below.

Figures 9, 10:
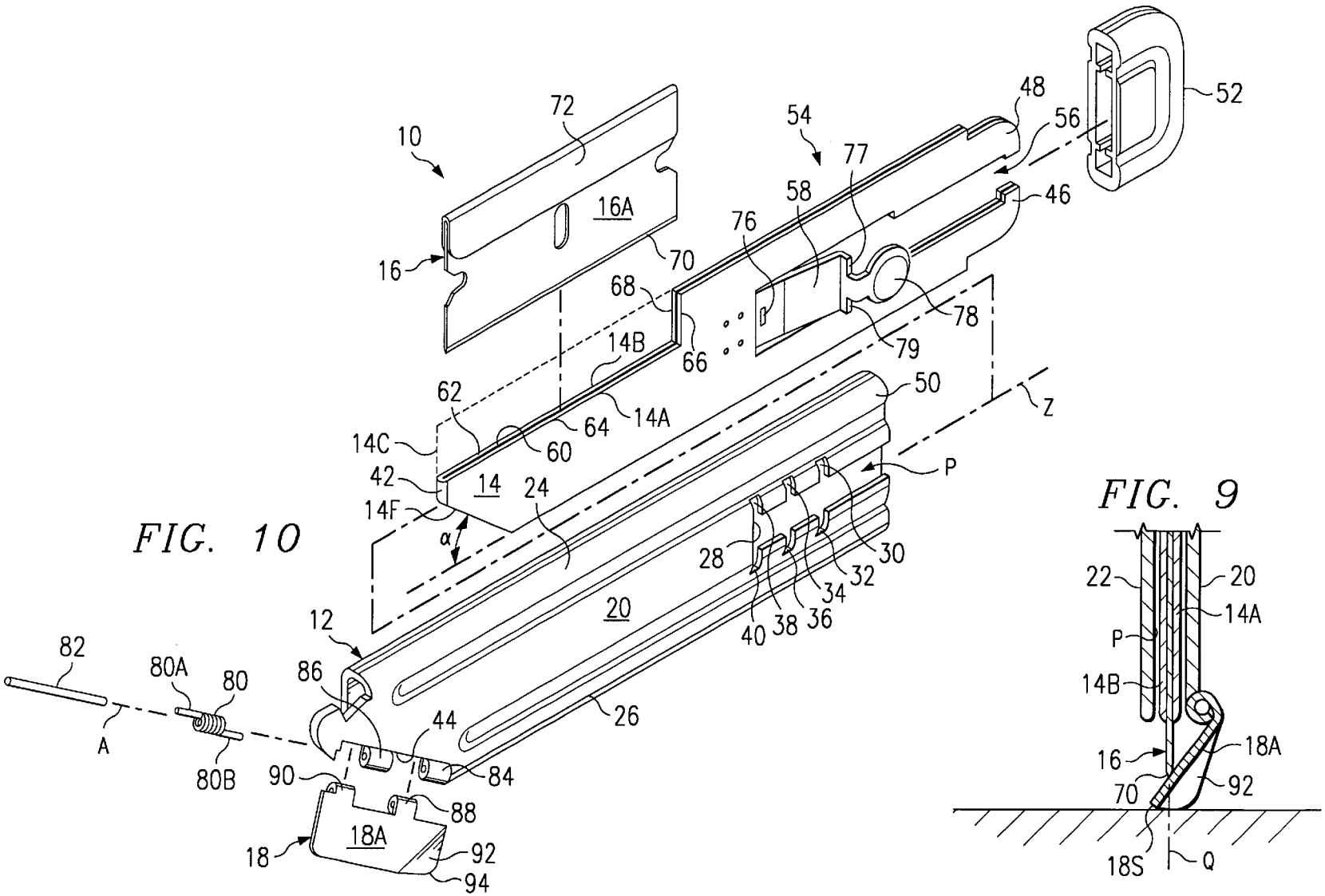
FIG. 9 is a sectional elevation view of the cutting blade and safety shield taken along the line 9—9 of FIG. 8, showing the safety shield in the covered, protective position.
FIG. 10 is an exploded perspective view of the box cutter shown in FIG. 1.

The keeper plate 14 is a single strip of aluminum or other metal stock for example 1/32" (0.0312 in.) thick sheet aluminum that is cut, stamped and doubled back over upon itself to provide the two sidewalls 14A and 14B that are joined at a fold 42 (FIG. 10). The fold 42 is relatively short inasmuch as the side walls 14A, 14B of the keeper plate at the front end of the handle have oblique margins which align with the oblique forward edges 44 on the handle 12 when the keeper plate is fully inserted into the handle 12. When the keeper plate is fully inserted, it is located along and in general registration with the front margins 44 of the two sidewall webs 20 and 22 of the handle. The keeper plate includes bayonet arms 46, 48 that project beyond the rear end 50 of the handle for engaging a plastic end cap 52.

The cutting or forward end 44 of the handle 12 is stamped at an acute angle alpha ($\alpha$) relative to the longitudinal axis Z of the handle to aid in guiding the utility knife 10 during a cutting operation. The rear end 50 of the handle is squared off to provide a smooth butt union 47 with the plastic end cap 52. The end cap is secured by interlocking engagement with the bayonet arms 46,48.

The keeper plate is preferably cut and stamped to accommodate the cutting blade 16 and depth-of-cut positioning components. The upper portions of the two side walls 14A and 14B at the front of the keeper plate are cut away to provide a rectangular window opening 14C that opens upwardly and also above the fold 42 to accommodate insertion of the cutting blade 16. The two sidewalls are also cut away to provide a rectangular latch deflection slot 56 for accommodating lateral deflection of a button member acting in cooperation with a spring arm 58 attached to the keeper plate for setting the depth of cut, as described below.

The two sidewalls 14A and 14B of the keeper plate are laterally spaced on opposite sides of a blade receiver pocket 60 which is sized for a snug slip fit with the rectangular blade portion 16A. The rectangular window opening 14*c* is bordered by the fold 42, keeper plate edge portions 62,64 and stepped shoulders 66,68 that serve as retainer shoulders for confining and positioning the cutter blade 16. The keeper plate 14 has a forward edge 14F that is angled to match the slope of the forward end 44 of the handle 12.

Preferably, the cutter blade 16 is a conventional single-edge razor blade. Optionally, the cutting blade may be a conventional utility blade that is readily available at hardware stores, paint stores and the like, that is sold primarily for use with various knives and scrapers that are designed to accommodate it. More specifically, the blade 16 has a thin rectangular blade portion 16A which along one of its longer margins is honed to a sharp cutting edge 70. The opposite margin of the rectangular blade portion 16A is fitted with a band or cap 72 which folds over and extends along both faces of the rectangular blade portion 16A in parallel with the cutting edge 70, and is firmly secured to the rectangular blade portion 16A. The cap 72 is sized for a smooth slip fit through the handle slide pocket P and fits flush within the rectangular cutout window against the blade retainer shoulders 62,64 and stepped shoulders 66,68 when the blade 16 is properly loaded in the keeper plate.

To insert the blade 16 into the keeper plate 14, the keeper plate must first be withdrawn from the handle 12. Then the cutting edge 70 of the blade is aligned with the lower margin of the cutout opening 14C in the keeper plate and then the rectangular blade portion 16A is forced into the blade receiver pocket 60 between the keeper plate sidewalls 14A, 14B until the band 72 of the blade 16 seats against the retainer shoulders 62,64 along the lower margin of the cutout opening. While most of the thin rectangular blade portion 16A is captured between the two sidewalls 14A, 14B of the keeper plate, a triangular blade segment 16T (FIG. 6) projects beyond the oblique margins 44 at the front of the keeper plate, thus exposing the cutting edge 70 in this region. The cutting edge 70 is positioned in parallel with the lower longitudinal edge of the keeper plate and is offset only slightly above the lower edge of the knife. The exposed portion of the triangular blade segment 16T corresponds with the maximum depth of cut, for example ¼ inch, at the maximum setting F.

Since the oblique margins 14F of the keeper plate register with the oblique edges 44 of the handle 12 when the keeper plate is fully inserted, the triangular blade segment 16T that projects beyond the keeper plate likewise projects beyond the oblique edges of the handle 12, thereby exposing the cutting edge 70 generally as a continuation of the lower edge of the handle. It is this segment of the blade that is used for cutting purposes, and when the edge 70 along it becomes dull, the blade 16 may be reversed to expose the unused cutting edge. In any event, the blade 16 is held firmly in the handle 12 by reason of its thin rectangular portion 16A being clamped tightly between the side walls of the keeper plate and restrained at its leading end by the fold 42 and further by reason of its band 72 being captured between the margins of the cutout window 14A and the overlying upper edge 24 of the handle. When the cutter blade is so positioned, its cutting edge 70 is parallel to the longitudinal axis Z of the handle 12.

Referring to FIG. 6, the depth of cut is adjusted by moving the keeper plate to one of the preset depth-of-cut positions F (blade fully extended), M (intermediate), and R (blade fully retracted). The keeper plate and blade assembly 54, illustrated in FIG. 10, is slidably retained in the slide pocket P between the handle sidewall webs 20, 22 and the top and bottom handle edges 24,26, respectively. The blade 16 is constrained to slide in side-by-side relationship with the keeper plate within the pocket, the assembly 54 being adjustably extendable and retractable in and out of the forward end of the handle at the pre-set positions F, M and R by manual engagement of a latching shoulder 77,79 with one of the detent notches 30, 32; 34,36; and 38,40.

The detent notches are fixed along the latch slot 28 at longitudinally spaced positions providing a fully extended detent position F corresponding with at least a segment of the blade and its cutting edge projecting beyond the front end of the handle at a first depth of cut, a partially extended detent position M corresponding with a relatively shorter a segment of the blade and its cutting edge projecting beyond the front end of the handle at a second depth of cut, and a fully retracted detent position R corresponding with the blade and its cutting edge 70 being completely withdrawn within the handle whereby no portion of the cutting edge is exposed.

Referring now to FIG. 10, the resilient latch arm 58 is supported in a cantilever arrangement in which it is laterally offset from the latch slot 56 on one side of the keeper plate by a short coupling stub 76 that is staked to the keeper plate 14. The latch arm and coupling stub 76 are integrally formed from a thin, flat strip of spring steel having a gauge thickness of about 1/32" (0.0312 inch). The opposite end of the latch arm is terminated by an actuator button 78 and latch shoulders 77,79 that are also integrally formed with the latch arm.

In response to manual depression of the actuator button, the latch arm 58 is deflected into the latch slot 56, carrying the latch shoulders below the handle sidewall web 20 and clear of the detent notches 30, 32; 34,36; and 38,40. The keeper plate 14 is then free to slide through the handle pocket P until the latch shoulders are brought into alignment with a selected pair of the detent notches that correspond with a desired depth of cut. Upon release, the latch arm 58 returns to its original orientation, bringing the latching shoulders 77,79 into interlocking registration with the selected notch pair. The position of the keeper plate is then fixed, and the position of the blade 16 is relative to the forward end of the handle is likewise fixed.

To improve the safety of the utility knife 10, a guard 18 including a deflectable shielding portion 18A is mounted on the handle 12 at the front end of the handle along one side of the blade, the guard being movable to a protective position (FIG. 8, FIG. 9) in which the shielding portion of the guard extends transversely across the cutting plane Q of the blade and the cutting edge 70 is covered, and to a retracted position (FIG. 6. FIG. 7) in which a blade segment 16T and the cutting edge 70 are exposed. A portion of the shield extends over-center with respect to the cutting edge, thereby tending to hold the shield in the protective guard position in response to contact of the shield against the operator at the normal angle of engagement during follow-through that accompanies rapid slicing hand movements.

The guard 18 is resiliently biased for movement to the guard position by a torsion spring 80, which yieldably opposes deflection of the shield away from the protective position. Referring to FIG. 1 and FIG. 10, the guard 18 is movably coupled to the handle web 20 by hinge assembly consisting of a hinge pin 82 and hinge coupling knuckles 84, 86 formed on the handle web and hinge coupling knuckles 88,90 formed on the guard 18. The coupling knuckles are aligned and interdigitated to form a conventional hinge with the torsion spring confined between adjacent coupling knuckles. The hinge pin is inserted through the aligned knuckles and torsion spring, supporting swinging or pivotal movement of the guard 18 relative to the handle 12 about an axis A. Torsional forces are coupled to the handle 12 by an end portion 80A of the spring, and are coupled to the guard 18 by and end portion 80B of the spring.

The hinge axis A is laterally offset from the blade cuffing plane Q and slopes obliquely relative to the blade cutting edge 70. According to this arrangement, the shield portion 18A is extended in sloping or skew relation with the cuffing plane Q of the blade and completely blocks contact with the cutting edge 70 against the operator or work surface (FIG. 8, FIG. 9) when the guard is in the protective position. The shielding portion 18A has length and width dimensions sufficient to completely overlap one side of the blade segment 16T and cover its cuffing edge 70 when the guard overlies the blade in the protective position.

In the preferred embodiment, the shield portion 18A comprises a flat plate that is substantially rectangular in profile, with a linear side edge 18S. A portion of the shield extends over-center with respect to the cuffing edge of the blade when the guard is in the protective position, so that pressure forces acting against the shield portion 18A tend to hold the shield in the protective covering position. Thus the blade cuffing edge 70 remains covered in response to contact of the shield side edge 18S against the operator or some other surface (FIG. 8, FIG. 9) at the normal angle of engagement during follow-through that accompanies rapid hand movements.

During normal handling and hand movements accompanying follow-though after the desired cut has been made, the guard side edge S or the flat side surface 18A of the guard will be moved into pressured contact more or less squarely F against the operator or work surface, as shown in FIG. 8 and FIG. 9, thus avoiding injury, since such pressure contact will reinforce the covered position of the guard. When the operator desires to perform a cuffing operation it is necessary to overcome the bias force of the torsion spring 80 and move the guard away from its protective covering position to expose the blade and its cuffing edge so that a cut can be made.

For this purpose, the guard 18 includes a small outwardly-turned flange portion 92 that projects transversely with respect to the shield. The flange portion prevents inadvertent digging into the cutting surface and provides an angularly offset leverage point or shoulder 94 on the lower end of the shield for initially engaging the box surface B and reacting the torsion spring when the operator desires to perform a cutting operation. Preferably, the flange portion is flared or sloped by an angle of about 20 degrees relative to the plane of the shield portion 18A. A pressure force of about three pounds applied through the flange portion against the box B is sufficient to overcome the bias force of the torsion spring 80. The shield 18A swings away from the cutting blade 16 in response to pressure engagement of the small flange portion 92 against the box surface B, thus exposing the blade segment 16T and the cutting edge 70 so that the cutting operation can proceed.

To use the utility knife 10 to cut open a corrugated box B, the knife is grasped along its handle 12 and moved toward the box with the axis Z of the handle presented at an angle of perhaps 30 to 60 degrees with respect to the side of the box. The orientation of the knife should be such that the outwardly-turned flange portion 92 of the guard 18 first contacts the box as the operator pulls the knife at the onset of the cut. Thus, as the knife continues to advance, a pressure force is applied through the flange portion 92 against the box B sufficient to overcome the bias force of the torsion spring 80. The shield 18A then pivots about the hinge pin 82 and swings away from the cutting blade 16 as the flange portion engages the surface of the box B. This exposes the blade segment 16T and its cutting edge 70 for penetration into the box sidewall as shown in FIG. 6 and FIG. 7.

As the knife is pulled toward the operator, the cutting edge 70 cuts into the box sidewall, penetrating to the full extent of the projection of the blade segment 16T beyond the handle 12. The blade 16 is forced into the box sidewall until the oblique edges 44 at the front end of the handle 12 are pulled into contact against the box. Once the blade segment 16T is fully inserted, the knife 10 is pulled along the box at approximately the same angle, and of course as the knife moves, its cutting edge slits the sidewall of the box. The shield 18A slides along the box surface, as shown in FIG. 6, as the knife is pulled through the cut. As the blade exits from the box, the torsion spring 80 automatically returns the shield 18 to the guard position. The shield covers the cutting edge and prevents inadvertent blade contact with the operator immediately after the knife is disengaged and during follow-through that accompanies rapid hand movements.

In short, the guard will immediately swing across the cutting plane of the blade and shield the cutting edge so that the blade cannot harm the operator or someone nearby. In this regard, it must be recognized that the box material exerts a considerable amount of resistance on the knife blade and accordingly the knife must be pulled with a considerable amount of force. Once this resistance is released, which occurs when the blade 16 passes beyond the edge of the box, the force, unless restrained, will propel the knife 10 in a condition of lesser control. Since the guard 18 immediately returns to the blade covering position upon disengagement of the blade from the box, the chances of cut injury are diminished substantially. Moreover, because of the over-center orientation of the guard in the protective position, the operator can safely handle the box cutter with the same care and attention devoted to other hand tools and with confidence that an accidental cut is not likely, for example when picking up the knife and handling it in preparation for a job, putting the knife away or carrying it while it is not being used.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. A utility knife comprising a handle, a blade mounted in the handle, the blade having a cutting edge and being positioned such that at least a segment of the blade and its cutting edge project beyond a front end of the handle; a safety shield coupled to the handle for movement from a protective position in which the shield extends transversely across a cutting plane of the blade and covers one side of the blade segment and overlies its cutting edge, to a retracted position in which the blade segment and its cutting edge are exposed, with a portion of the shield extending over-center with respect to the cutting edge of the blade when the shield is in the protective position, a spring coupled to the safety shield yieldably opposing swinging movement of the shield away from the protective position and returning the shield to the protective position automatically upon disengagement, and the safety shield including an outwardly-turned flange portion that projects transversely with respect to the shield, the flange portion preventing inadvertent digging into a cutting surface and providing an angularly offset leverage point on the shield for reacting the spring and allowing the shield to move away from the cutting plane automatically in response to pressure engagement of the flange portion against a box surface, thus exposing the blade segment and its cuffing edge when an operator desires to perform a cutting operation.

2. A utility knife comprising, in combination:

a handle including a front end and a rear end;

a blade mounted in the handle, the blade having a cutting edge positioned such that at least a segment of the blade and its cutting edge project beyond a front end of the handle;

a guard including a shielding portion mounted on the handle at the front end of the handle along one side of the blade and an outwardly turned flange portion that projects transversely with respect to the shielding portion, the guard being movable between a protective position in which the shielding portion of the guard extends transversely across a cutting plane of the blade and a retracted position in which the blade segment and the cutting edge are exposed; and a spring coupled to the handle and to the guard yieldably biasing the guard for movement toward the protective position.

3. A utility knife according to claim 1, wherein the spring is a torsion spring, the torsion spring having a first end portion coupled to the handle and a second end portion coupled to the guard.

4. A utility knife according to claim 1, wherein the guard is mounted for movement between the protective position and the retracted position about an axis that is offset from the blade.

5. A utility knife according to claim 1, wherein the guard is mounted for movement between the protective position and the retracted position, wherein the guard includes a shield portion that extends substantially in skew relation with the cutting plane of the blade in the protective position.

6. A utility knife according to claim 1, wherein the cuffing edge of the blade is linear and the guard is mounted for movement between the protective position and the retracted position about an axis that extends obliquely relative to the cuffing edge of the blade.

7. A utility knife according to claim 1, including a hinge coupled to the handle, and the guard is mounted on the hinge for pivotal movement between the protective position and the retracted position.

8. A utility knife according to claim 1, wherein at least a portion of the guard extends over-center with respect to cutting edge of the blade when the guard is in the protective position.

9. A utility knife according to claim 1, wherein the guard comprises a flat plate that is substantially rectangular in profile.

10. A utility knife according to claim 1, wherein the guard comprises side edge portions defining the boundary of the shielding portion having length and width dimensions sufficient to completely cover one side of the blade segment and its cutting edge when the guard is in the protective position, and one of the side edge portions is movably coupled to the handle.

11. A utility knife according to claim 1, wherein the guard comprises side edge portions forming the boundary of the shielding portion having length and width dimensions defining a flat plate that is substantially rectangular in profile.

12. A utility knife according to claim 1, wherein:

the guard including side edge portions defining the boundary of the shielding portion;

one of the side edge portions comprising an outwardly turned flange portion that projects transversely with respect to the shielding portion, and one of the side edge portions is movably coupled to the handle.

13. A utility knife according to claim 1, wherein the handle includes first and second sidewalls and a pocket formed between the sidewalls, and a blade carrier is disposed within the pocket for holding the blade so that at least a segment of the blade and its cutting edge project beyond the front end of the handle.

14. A utility knife according to claim 1, wherein the guard comprises side edge portions defining the boundary of the shielding portion, the shielding portion having length and width dimensions sufficient to completely overlap one side of the blade segment and cover its cutting edge when the guard is in the protective position, and one of the side edge portions is movably coupled to the handle.

15. A utility knife according to claim 1, including a hinge coupled to the handle and the guard is mounted on the hinge for movement about a pivotal axis between the protective position and the retracted position, and the pivotal axis is laterally offset from the blade.

16. A utility knife according to claim 1, including a hinge coupled to the handle and the guard is mounted on the hinge for movement about a pivotal axis between the protective position and the retracted position, and wherein the handle has a longitudinal axis and wherein the cutting edge of the blade extends generally in parallel with the longitudinal axis, and the pivot axis is laterally offset from the longitudinal axis.

17. A utility knife comprising a handle, a blade mounted in the handle, the blade having a cutting edge and being positioned such that at least a segment of the blade and its cutting edge project beyond a front end of the handle; a shield coupled to the handle for movement from a protective position in which the shield extends transversely across a cutting plane of the blade and covers one side of the blade segment and its cutting edge, to a retracted position in which the blade segment and its cutting edge are exposed, with a portion of the shield extending over-center with respect to the cutting edge of the blade when the shield is in the protective position, so that pressure forces acting against the shield tend to hold the shield in the protective position and the cutting edge of the blade remains covered in response to contact of the shield against an operator during follow-through that accompanies rapid hand movements, and including a spring coupled to the shield yieldably opposing swinging movement of the shield away from the protective position and returning the shield to the protective position automatically upon disengagement.

18. A utility knife comprising a handle, a blade mounted in the handle, the blade having a planar body portion and a cutting edge formed on the planar body portion, at least a segment of the blade and its cutting edge projecting beyond a front end of the handle; a shield coupled to the handle for movement from a protective position in which the shield extends transversely across a cutting plane of the blade and overlies its cutting edge, to a retracted position in which the cutting edge is exposed, with a portion of the shield extending over-center with respect to the cutting edge of the blade when the shield is in the protective position, a hinge mounted on the handle, the shield being coupled to the hinge for pivotal movement about a pivot axis that extends substantially in parallel with the planar body portion and including a spring coupled to the shield yieldably opposing movement of the shield away from the protective position and urging the shield to the protective position automatically upon disengagement so that pressure forces acting against the shield tend to hold the shield in the protective position and the cutting edge of the blade remains covered in response to contact of the shield against an operator during follow-through that accompanies rapid slicing hand movements.

19. A utility knife comprising, in combination:

a handle including a front end and a rear end;

a blade mounted in the handle, the blade having a planar body portion and a cutting edge formed on the planar body portion;

a guard including a shielding portion disposed proximate the front end of the handle, the guard being movable to a protective position in which the shielding portion of the guard extends across a cutting plane of the blade and overlies said cutting edge, and movable to a retracted position in which said cutting edge is exposed;

a hinge disposed on the handle in side-mount relation to the blade, the guard being coupled to the hinge for pivotal movement about a pivot axis that extends substantially in parallel with the planar body portion; and a spring coupled to the handle and to the guard yieldably biasing the guard for movement toward the protective position.

* * * * *